US007442023B2

(12) United States Patent
Kuwabara et al.

(10) Patent No.: US 7,442,023 B2
(45) Date of Patent: Oct. 28, 2008

(54) MOLDING TOOL

(75) Inventors: Mitsuo Kuwabara, Tsurugashima (JP); Masanori Ohtsuka, Tochigi-ken (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 156 days.

(21) Appl. No.: 11/641,022

(22) Filed: Dec. 19, 2006

(65) Prior Publication Data

US 2007/0098832 A1 May 3, 2007

Related U.S. Application Data

(62) Division of application No. 10/450,683, filed as application No. PCT/JP01/10886 on Dec. 12, 2001, now Pat. No. 7,169,347.

(30) Foreign Application Priority Data

Dec. 19, 2000 (JP) ..... 2000-385278
Aug. 3, 2001 (JP) ..... 2001-236885
Aug. 3, 2001 (JP) ..... 2001-236908

(51) Int. Cl.
*B29C 33/00* (2006.01)

(52) U.S. Cl. ..... 425/175

(58) Field of Classification Search ..... 425/175–180; 246/219–227

See application file for complete search history.

(56) References Cited

U.S. PATENT DOCUMENTS 4,830,930 A 5/1989 Taniguchi et al.
5,181,953 A 1/1993 Nakano et al.
5,248,352 A 9/1993 Nakahara et al.
5,306,339 A * 4/1994 Takeda et al. ..... 65/374.12
5,494,635 A 2/1996 Bennett
5,648,029 A 7/1997 Collin
5,694,639 A 12/1997 Oskarsson et al.
5,761,593 A 6/1998 Ostlund et al.
6,090,343 A 7/2000 Kear et al.
6,156,246 A 12/2000 Chatterjee et al.
6,918,943 B2 7/2005 Kuwabara et al.

FOREIGN PATENT DOCUMENTS

EP 0 635 580 A1 8/1994
WO WO-00/50657 A1 8/2000

* cited by examiner

*Primary Examiner*—Yogendra Gupta
*Assistant Examiner*—Thu Khanh T Nguyen
(74) *Attorney, Agent, or Firm*—Birch, Stewart, Kolasch & Birch, LLP

(57) ABSTRACT

A die comprises metal-rich sections which form an inner wall and an outer wall of the die, respectively. Gradient sections are disposed adjacent to the metal-rich sections, respectively. Further, a ceramics-rich section is disposed between the gradient sections. A punch comprises an inner ceramics-rich section, a gradient section, and an outer metal-rich section. In the die, the composition ratio of metal gradually decreases from the metal-rich sections to the ceramics-rich section. Similarly, in the punch, the composition ratio of the metal gradually decreases from the metal-rich section to the ceramics-rich section.

5 Claims, 6 Drawing Sheets

MOLDING TOOL

TECHNICAL FIELD

The present application is a Divisional of U.S. patent application Ser. No. 10/450,683, filed on Jun. 17, 2003 now U.S. Pat. No. 7,169,347 and for which priority is claimed under 35 U.S.C. §120. Application Ser. No. 10/450,683 is a National Phase of PCT International Application No. PCT/JP01/10886 filed on Dec. 12, 2001 under 35 U.S.C. §371, which claims priority of JP 2000-385278 filed in Japan on Dec. 19, 2000; JP 2001-236885 filed in Japan on Aug. 3, 2001 and JP 2001-236908 filed in Japan on Aug. 3, 2001.

The present invention relates to a molding tool which is formed of a gradient composite material containing ceramics and metal, and a method of producing the same.

BACKGROUND ART

A molding tool for punching a hole in a workpiece comprises a punch for pressing the workpiece and a die having a cavity for receiving the punch. The die is positioned under the punch. Normally, the workpiece is placed on the die. Then, the punch is displaced downwardly toward the die. A distal end of the punch is inserted into the cavity of the die. As a result, the workpiece is pierced by the punch.

Constitutive materials adopted for the die or the punch include, for example, SK material, SKD material, or SKH material defined by Japan Industrial Standard (so-called high speed tool steel) containing high carbon steel as a major component, super alloy material such as nickel-based alloy and cobalt-based alloy, and superhard material as composite material of ceramics and metal. In order to improve abrasion resistance, the surface of the die or the punch is sometimes coated with a coating film of hard ceramics such as TiC or TiN.

The high speed tool steel and the super alloy material have high strength and high toughness. However, the high speed tool steel and the super alloy do not have sufficient abrasion resistance, compressive strength, and rigidity. The superhard material has high abrasion resistance, compressive strength, and rigidity. However, the superhard material does not have sufficient toughness and tends to cause cracks and breakage. That is, the characteristics of the high speed tool steel and the super alloy material are opposite to the characteristics of the superhard material. Therefore, the constitutive material for the die or the punch is selected in consideration of the constitutive material of a workpiece.

It is desirable that the die or the punch has high hardness, high strength, and high toughness. High hardness, i.e., high abrasion resistance is essential for a long service life. High strength helps to prevent deformation of the die or the punch, even if high stress is exerted thereon in piercing a hole in a workpiece. Further, the die or the punch having high toughness scarcely suffers from the occurrence of cracks and breakage. However, conventional dies or punches do not have all of the characteristics described above.

For example, in the case of the die or the punch composed of a superhard material, it is possible to improve toughness by increasing the composition ratio of metal. However, the superhard material having high metal composition ratio does not have high hardness and strength. Therefore, the service life of the die or the punch may not be long. In contrast, it is possible to improve hardness and strength by decreasing the composition ratio of metal at the sacrifice of toughness. However, the cracks and breakage tend to occur more frequently.

As described above, the superhard material having high hardness and strength does not have high toughness. The superhard material having high toughness does not have high hardness and strength. Therefore, it is difficult to improve all of the characteristics (hardness, strength, and toughness) of the die or the punch.

DISCLOSURE OF INVENTION

The present invention has been made in order to solve the problem as described above, and an object of which is to provide a molding tool formed of a gradient composite material which has a long service life in which deformation, cracks and breakage scarcely occur, and a method of producing the molding tool.

In order to achieve the above object, according to the present invention, a molding tool comprises a punch for pressing a workpiece and a die having a cavity for receiving the punch, wherein the punch is composed of a composite material containing ceramics and metal, and wherein a composition ratio of the ceramics is increased and a composition ratio of the metal is decreased inwardly from a surface of the punch.

The punch constructed as described above has toughness of metal, and hardness and strength of ceramics. Therefore, the punch is suitably used for producing a molding tool in which the cracks and the breakage scarcely occur, abrasion resistance is improved, and the deformation scarcely occurs.

Suitable ceramics materials used for the punch include at least one selected from the group consisting of carbide, nitride, and carbonitride of W, Cr, Mo, Ti, V, Zr, Hf, and lanthanoid. Suitable metal materials used for the punch include at least one selected from the group consisting of Fe, Ni, Co, and alloy composed of two or more of these metals. Additionally, the metal may further contain at least one of Cr, Mn, V, and Ti.

In this case, the composition ratio of ceramics to the composition ratio of metal is 60:40 to 95:5 by weight. If the metal is less than 5 parts by weight, the cracks and breakage tend to occur, because the toughness is poor. If the metal exceeds 40 parts by weight, hardness and strength, and abrasion resistance are poor. Therefore, the deformation tends to occur when a workpiece is punched out.

It is preferable that the surface of the punch has Vickers hardness of not less than 1200 for prolonging the service life of the punch and improving the accuracy of punching the workpiece.

According to another aspect of the present invention, a method of producing a molding tool comprises the steps of:

forming a compact using mixed powder comprising ceramics powder and metal powder;

sintering said compact to prepare a porous member (primary sintering step);

impregnating the porous member with a catalyst-containing solution; and resintering said porous member impregnated with the catalyst-containing solution in an atmosphere of nitriding gas to prepare a dense sintered product as a punch (secondary sintering step), wherein the nitriding gas is introduced into a furnace at the beginning of raising temperature of the furnace in the resintering step.

In this procedure, in the secondary sintering step, the metal grains existing in the vicinity of the surface of the porous member start the grain growth earlier than the ceramics grains. Further, the grain growth of the ceramics grains existing in the vicinity of the surface of the porous member are suppressed by the nitriding gas such as nitrogen, because the nitriding gas generally inhibits the grain growth of the ceramic gains. The grain growth of the ceramics grains existing centrally in the porous member is not suppressed, because the nitriding gas hardly exists centrally in the porous member. Further, the grain growth of the ceramics grains in the porous member is accelerated by the catalyst.

For the reason as described above, the metal grains are concentrated in the vicinity of the surface. In this manner, it is possible to obtain the punch (gradient composite material) in which the composition ratio of the metal is decreased and the composition ratio of the ceramics is increased inwardly from the surface.

In order to provide the molding tool having sufficient hardness, strength, and toughness for use in plastic forming and punch press stamping, it is preferable that the ceramics grains are composed of at least one selected from the group consisting of carbide, nitride, and carbonitride of W, Cr, Mo, Ti, V, Zr, Hf, and lanthanoid, and the metal grains are composed of at least one selected from the group consisting of Fe, Ni, Co, and alloy comprising two or more of these metals. Further, at least one of Cr, Mn, V, and Ti may be added to the metal grains. In this case, the composition ratio of ceramics and metal is 60:40 to 95:5 by weight. If the metal is less than 5 parts by weight, the cracks and breakage tend to occur, because toughness is poor. If the metal exceeds 15 parts by weight, hardness and strength, and abrasion resistance are poor. Therefore, the deformation tends to occur when a workpiece is punched out.

Fe, Ni, Co, Mn, Cr, Mo, Ti, or lanthanoid are preferable examples of the catalyst in the catalyst-containing solution.

The nitriding gas is preferably nitrogen, for example, since it is easy to handle the gas and it is easy to control the reaction velocity.

The above and other objects, features, and advantages of the present invention will become more apparent from the following description when taken in conjunction with the accompanying drawings in which a preferred embodiment of the present invention is shown by way of illustrative example.

BEST MODE FOR CARRYING OUT THE INVENTION

A preferred embodiment of the molding tool and the method of producing the same according to the present invention will be described in detail with reference to the accompanying drawings.

Figure 1:
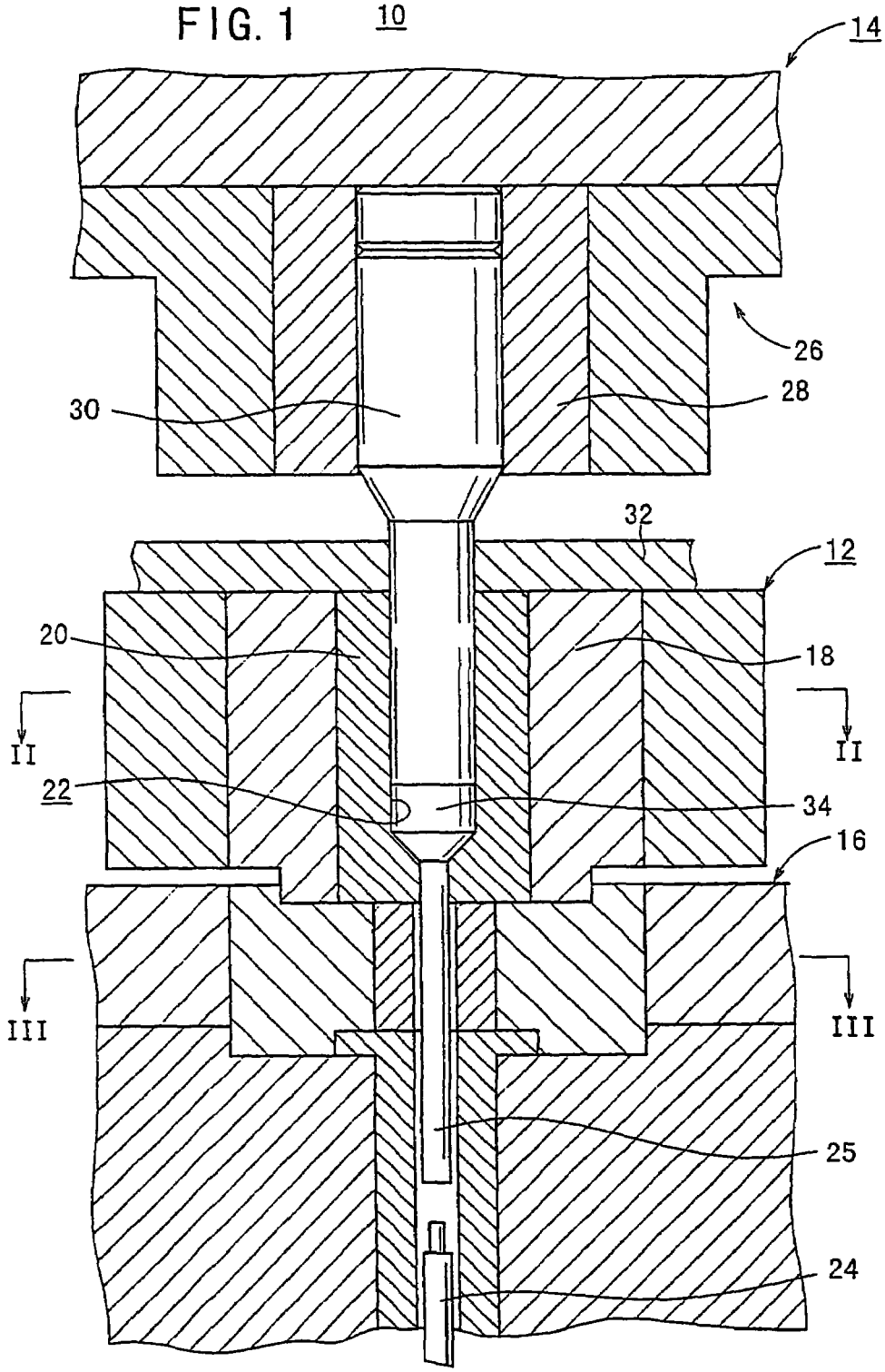
FIG. 1 is a longitudinal sectional view showing main components of a molding tool formed of a gradient composite material according to an embodiment of the present invention.

FIG. 1 is a longitudinal sectional view showing main components of a molding tool 10 formed of a gradient composite material according to the embodiment of the present invention. As shown in FIG. 1, the molding tool 10 comprises a lower fixed table 12 and an upper movable table 14. The fixed table 12 includes a die set 16 for supporting a reinforcement ring (die holder) 18. The reinforcement ring 18 holds a die 20. In the center of the die 20, a cavity 22 is defined. A distal end of a knockout pin 25 is slidably displaced in the cavity 22. The knockout pin 25 is displaced up and down when a rod 24 is displaced to abut against the knockout pin 25.

The movable table 14 includes a punch plate 26 for supporting a punch holder 28. The punch holder 28 holds a punch 30. When the movable table 14 is displaced downwardly, a workpiece 32 is pressed by the punch 30. In this manner, punch press stamping of the workpiece 32 is performed. In FIG. 1, a reference numeral 34 denotes a scrap punched out from the workpiece 32.

Figure 2:
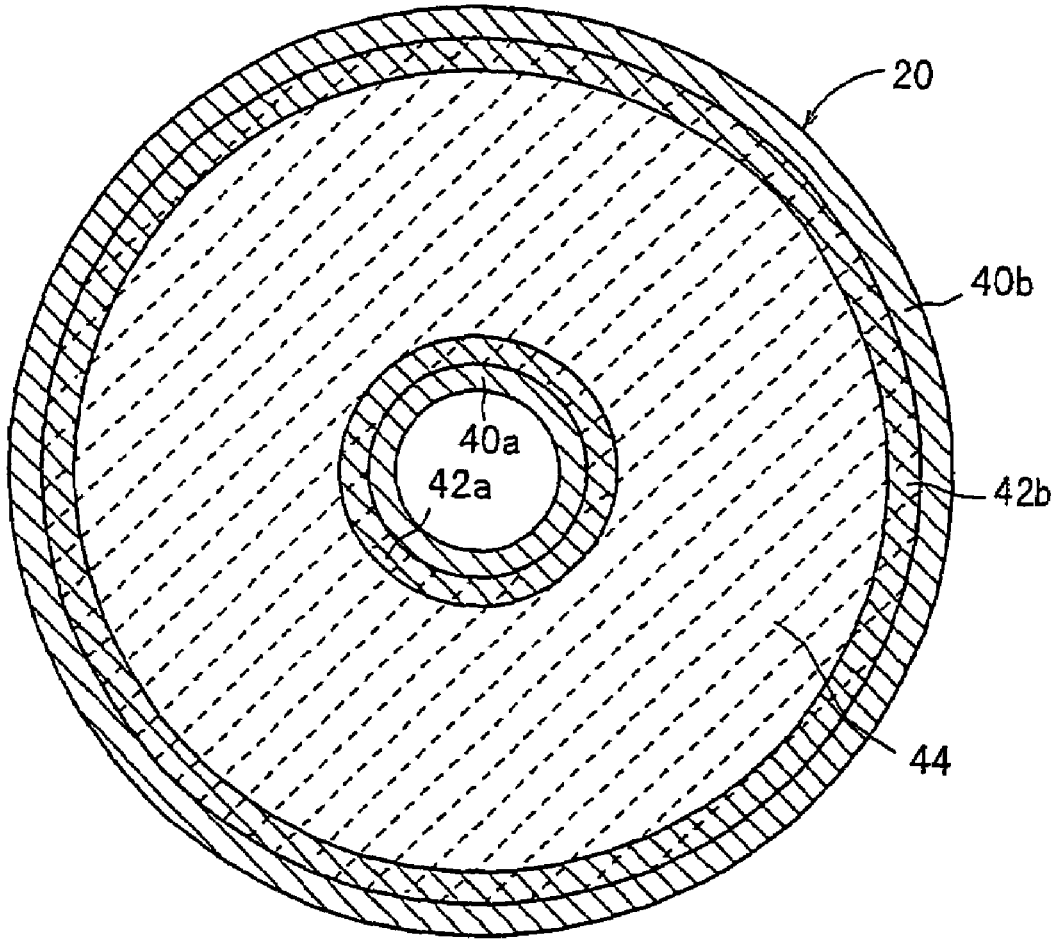
FIG. 2 is a cross sectional view as viewed along a line II-II indicated by arrows shown in FIG. 1.

FIG. 2 is a cross sectional view as viewed along a line II-II indicated by arrows shown in FIG. 1. As shown in FIG. 2, the die 20 has a cylindrical shape. The die 20 comprises five sections of different composition ratios. A metal-rich section 40*a*, and a metal-rich section 40*b* form an inner wall (inner surface) and an outer wall (outer surface) of the die 20, respectively. In each of the metal-rich sections 40*a*, 40*b*, the composition ration of metal is relatively large. Gradient sections 42*a*, 42*b* are disposed adjacent to the metal-rich sections 40*a*, 40*b*, respectively. Further, a ceramics-rich section 44 is disposed between the gradient sections 42*a*, 42*b*. In the ceramics-rich section 44, the composition ratio of ceramics is relatively large in comparison with the metal-rich sections 40*a*, 40*b*. In the gradient section 42*a*, the composition ratio of metal gradually decreases outwardly from the metal-rich section 40*a* to the ceramics-rich section 44. In the gradient section 42*b*, the composition ratio of metal gradually decreases inwardly from the metal-rich section 40*b* to the ceramics-rich section 44.

In the die 20, the composition ratio of metal is highest in the metal-rich sections 40*a*, 40*b* constituting the inner wall (inner surface) and outer wall (outer surface) of the die 20. The composition ratio of metal is gradually decreased from the metal-rich sections 40*a*, 40*b* to the ceramic-rich section 44. In contrast, the composition ratio of ceramics is lowest in the metal-rich sections 40*a*, 40*b* constituting the inner wall (inner surface) and outer wall (outer surface) of the die 20. The composition ratio of ceramics is gradually increased from the metal-rich sections 40*a*, 40*b* to the ceramic-rich section 44.

Additionally, the metal may further contain at least one of Cr, Mn, V, and Ti. When the ceramics and the metal as described above are used as the constitutive materials, it is possible to form the die 20 and the punch 30 having sufficient strength, hardness, and toughness.

When the above ceramics and metal are used as the constitutive materials for the die 20 and the punch 30, the composition ratio of ceramics and metal is 60:40 to 95:5 (weight ratio). If the metal is less than 5 parts by weight, the cracks and breakage tend to occur, because toughness is poor. If the metal exceeds 40 parts by weight, hardness and strength, and abrasion resistance are poor. Therefore, the deformation tends to occur when a workpiece is punched out.

It is preferable that the cavity surface defining the cavity of the die 20 has Vickers hardness (Hv) of not less than 1200. If Hv is less than 1200, the service life of the die 20 may not be long, because hardness is poor. Further, in this case, the coefficient of friction (μ) between the workpiece and the die 20 is high. As a result, heat and stress generated during punch press stamping are increased. Therefore, the surface of the workpiece tends to be punched out inaccurately. In order to ensure the accuracy of punching holes in the surface of the workpiece and the long service life of the die 20, it is preferable that Hv is not less than 1300.

In the molding tool 10 having die 20 and the punch 30 formed of a gradient composite material as described above, toughness is high at the surface (in the outer section), and hardness and strength are high in the inner section. That is, all of the hardness, strength, and toughness are sufficient when the workpiece is subjected to punch press stamping. Therefore, the service life is long, the deformation scarcely occurs, and the cracks and breakage scarcely occur.

Figure 4:
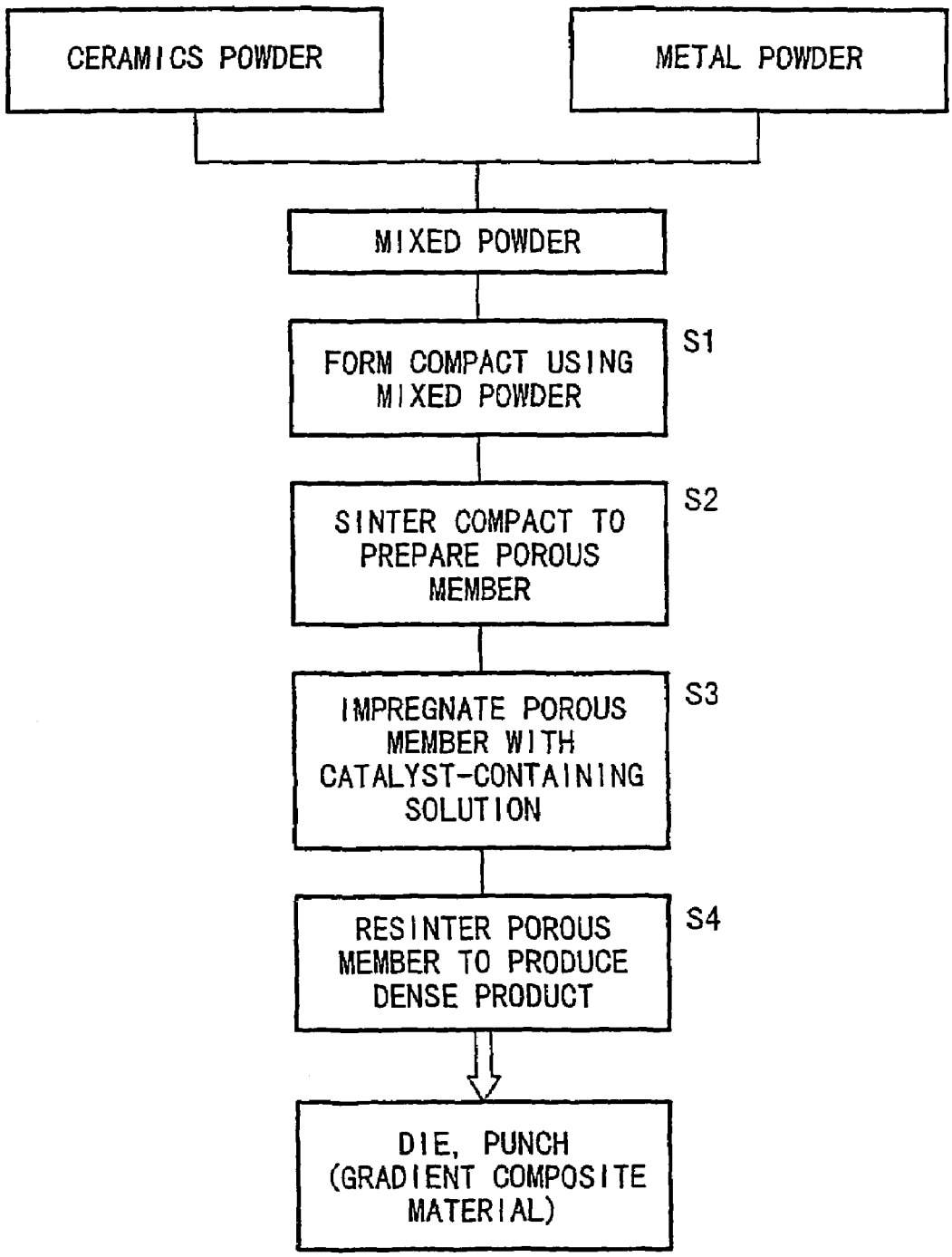
FIG. 4 is a flow chart illustrating a method of producing a punch and/or a die of the molding tool according to the embodiment of the present invention.

The die 20 and the punch 30 can be produced in accordance with a method shown in a flow chart in FIG. 4. As shown in FIG. 4, the production method comprises a sintering step S1 of obtaining a compact, a primary sintering step S2 of sintering the compact to prepare a porous member, an impregnating step S3 of impregnating the porous member with a catalyst-containing solution, and a secondary sintering step S4 of resintering the porous member to prepare a dense sintered product.

In step S1, ceramics powder and metal powder are mixed to obtain mixed powder. For the reason as described above, it is preferable to use ceramics powder of at least one selected from the group consisting of carbide, nitride, and carbonitride of W, Cr, Mo, Ti, V, Zr, Hf, and lanthanoid. Further, it is preferable to use metal powder of at least one selected from the group consisting of Fe, Ni, Co, and alloy comprising two or more of these metals. Further, at least one of Cr, Mn, V, and Ti may be added. The composition ratio of ceramics powder and metal powder (ceramics powder: metal powder) in the mixed powder is in the range of 60:40 to 95:5 by weight.

A forming load is applied to the mixed powder to prepare the compact having a shape corresponding to the die 20 or the punch 30. In this process, the forming load is determined such that the metal powder does not cause any plastic deformation, in order to obtain the porous member in the primary sintering step S2 as described later on. Specifically, it is preferable that the forming load is about 100 to 300 MPa. In this case, the occurrence of plastic deformation of the metal powder is successfully avoided, and hence open pores of the compact are not closed.

Subsequently, in the primary sintering step S2, the compact is sintered into the porous member such that the pores remain open. If a dense sintered product is prepared at this stage, it is difficult to impregnate the dense sintered product with the catalyst-containing solution in the impregnating step S3.

Therefore, the sintering temperature and the time in the primary sintering step S2 are determined such that only the metal grains are fused to one another, and the sintering process is finished when necks are formed between the metal grains. In the primary sintering step S2, the ceramics grains are not fused to one another. Accordingly, the volume is not changed significantly in the process in which the compact is converted into the porous member.

Subsequently, in the impregnating step S3, the porous member is impregnated with the catalyst-containing solution. Specifically, the porous member is immersed in the catalyst-containing solution. As a result of the immersion, the catalyst-containing solution permeates into the porous member via the open pores.

In the secondary sintering step S4, any catalyst which suitably facilitates the growth of the ceramics grains can be used, including, but not limited to, Fe, Ni, Co, Mn, Cr, Mo, Ti, and lanthanoid. Those usable as the catalyst-containing solution include a solution obtained by dissolving a metal salt containing the metal as described above in a solvent, and an organic metal solution.

In this procedure, the catalyst is dispersed or dissolved in the solvent, and dissociated into single molecules or ions. Therefore, in the impregnating step S3, the catalyst, which is dissociated into single molecules or ions, is uniformly dispersed in the porous member. Accordingly, the grain growth of the ceramics grains in the secondary sintering step S4 is facilitated inwardly from the surface, in the porous member.

After the impregnating step S3, the catalyst-containing solution is left to stand, and dried naturally. Alternatively, the porous member may be heated to dry the catalyst-containing solution.

Finally, in the secondary sintering step S4, the porous member is resintered in a nitrogen atmosphere to prepare the dense sintered product. The nitriding gas, which is used as the atmosphere, is introduced into a furnace at the beginning of raising temperature of the furnace in the secondary sintering step S4. Accordingly, the dense sintered product (gradient composite material), i.e., the die 20 or the punch 30 as the product, in which the composition ratio of ceramics and metal is 60:40 to 95:5, is obtained.

In the secondary sintering step S4, the grain growth of the ceramics grains existing in the vicinity of the surface of the porous member is inhibited by the nitriding gas as the atmosphere. The nitriding gas is hardly introduced into the porous member. Therefore, the degree of inhibition of the grain growth of the ceramics grains existing in the porous member by the nitriding gas is small as compared with the surface. Further, the grain growth of the ceramics grains existing in the porous member is facilitated by the catalyst.

Consequently, in the secondary sintering step S4, the grain growth of the ceramics grains is suppressed in the vicinity of the surface of the porous member, and the grain growth is facilitated in the porous member. As a result, the metal grains are rearranged such that the metal grains are concentrated in the vicinity of the surface. That is, in the resulting gradient composite material (die 20, punch 30), the composition ratio of the metal is high in the vicinity of the surface of the porous member, and the composition ratio of the ceramics is high in the porous member.

As described above, it is possible to increase the degree of the grain growth of the ceramics grains existing in the porous member impregnated with the catalyst-containing solution as compared with the portion located in the vicinity of the surface, in the secondary sintering step S4 by introducing the nitriding gas atmosphere at the beginning of raising temperature. Thus, rearrangement of the metal grains occurs. Accordingly, it is possible to obtain the gradient composite material (die 20 or punch 30) in which the composition ratio of metal is decreased and the composition ratio of the ceramics is increased inwardly from the surface.

In the embodiment of the present invention, the forming step Si and the primary sintering step S2 are performed separately. Alternatively, the both steps S1, S2 may be performed simultaneously, for example, by hot isostatic pressing (HIP).

EXAMPLES

Figure 3:
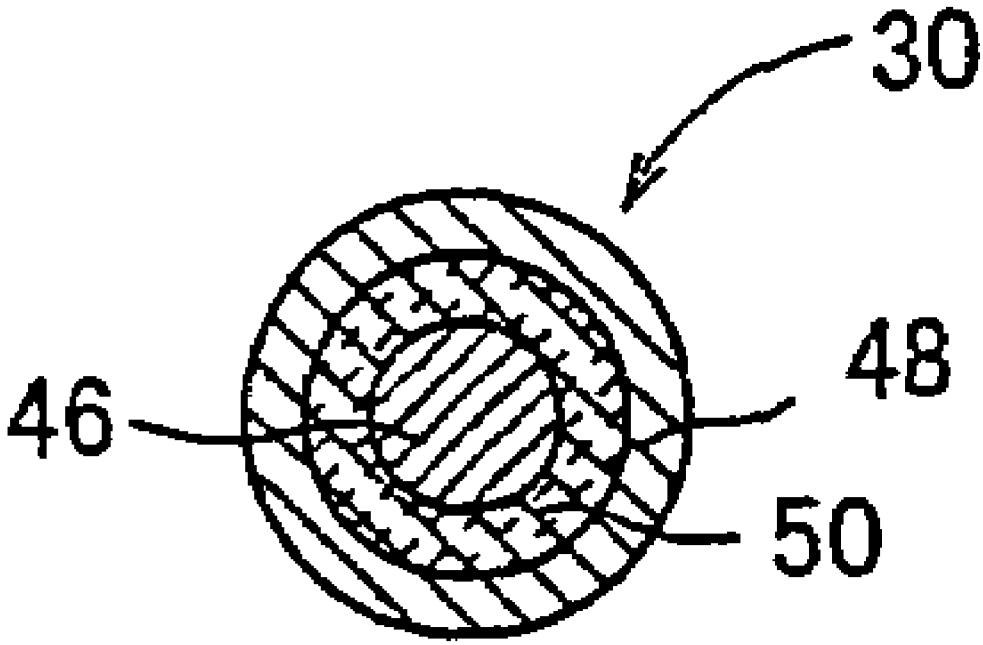
FIG. 3 is a cross sectional view as viewed along a line III-III indicated by arrows shown in FIG. 1.

Mixed powder was prepared by mixing, 90 parts by weight of tungsten carbide (WC) powder having an average grain size of 1 μm, and 10 parts by weight of cobalt (Co) having an average grain size of 1.4 μm. Subsequently, the mixed powder was formed to have a shape corresponding to the punch 30 (see FIGS. 1 and 3) with a molding pressure of 120 MPa to obtain a compact. The obtained compact was maintained at 1273 K for 30 minutes to prepare a porous member.

Subsequently, the porous member was immersed in a nickel nitrate solution having a concentration of 10% for one minute. Thus, the Ni ion was dispersed in the porous member. Then, the porous member was left for an hour at 90° C., and dried.

Subsequently, the porous member was placed in a nitrogen atmosphere for 90 minutes at 1400° C. Thus, the punch 30 formed of a gradient composite material was obtained. The nitrogen was introduced into a furnace at the time of raising temperature of the furnace.

Further, the die 20 (see FIGS. 1 and 2) formed of a gradient composite material was obtained in the same manner.

For the purpose of comparison, comparative dies and a comparative punches were prepared. In producing the comparative dies and comparative punches, the immersion process with the catalyst-containing solution was omitted. Durability of the die 20, punch 30, comparative die, comparative punch were tested under the condition as described later on.

Composition ratio of metal in the die 20 and the punch 30 were examined. In the metal-rich sections 40*a*, 40*b*, 48, the composition ratio of metal was 13 to 14 wt % (weight percent). In the ceramics-rich sections 44, 46, the composition ration of metal was 7 wt %.

Figure 5:
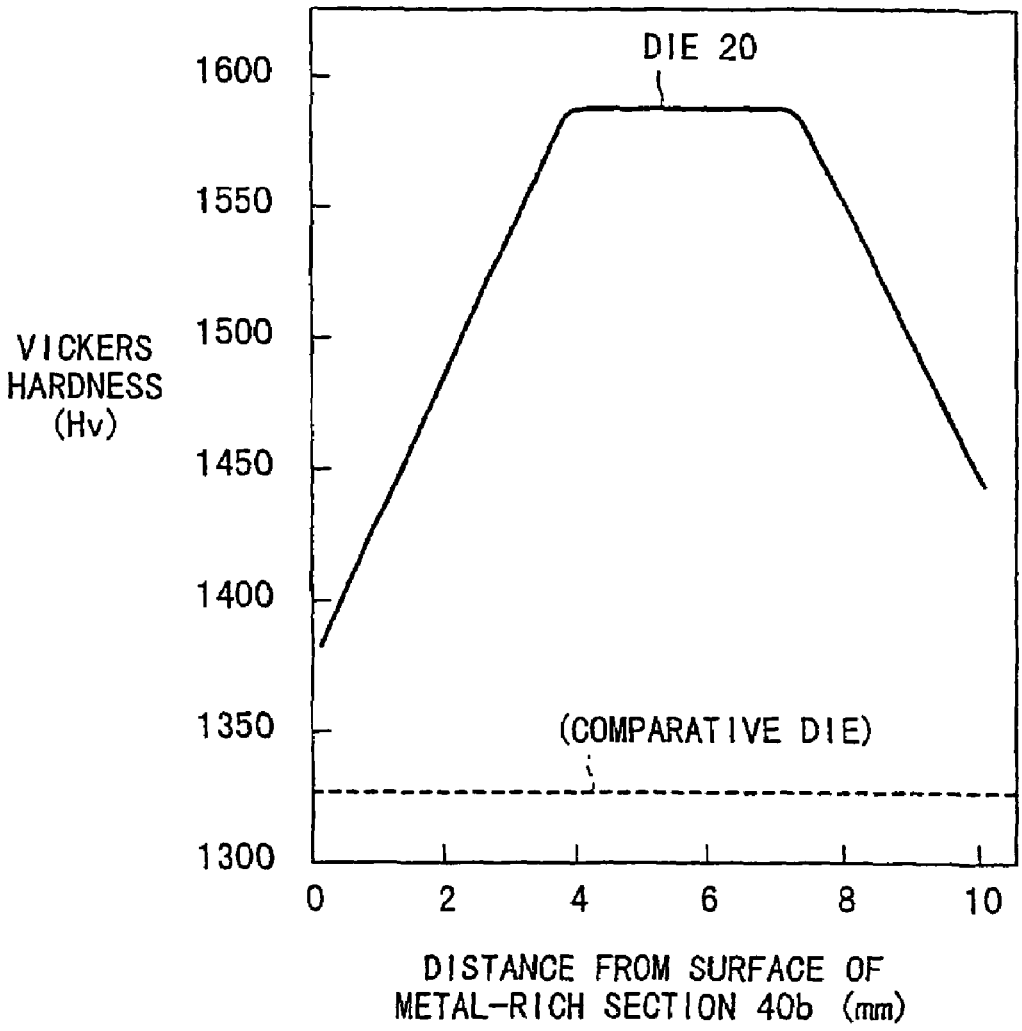
FIG. 5 is a graph illustrating Vickers hardness of the die shown in FIG. 2 depending on the distance from an outer surface of the die toward a cavity surface.
Figure 6:
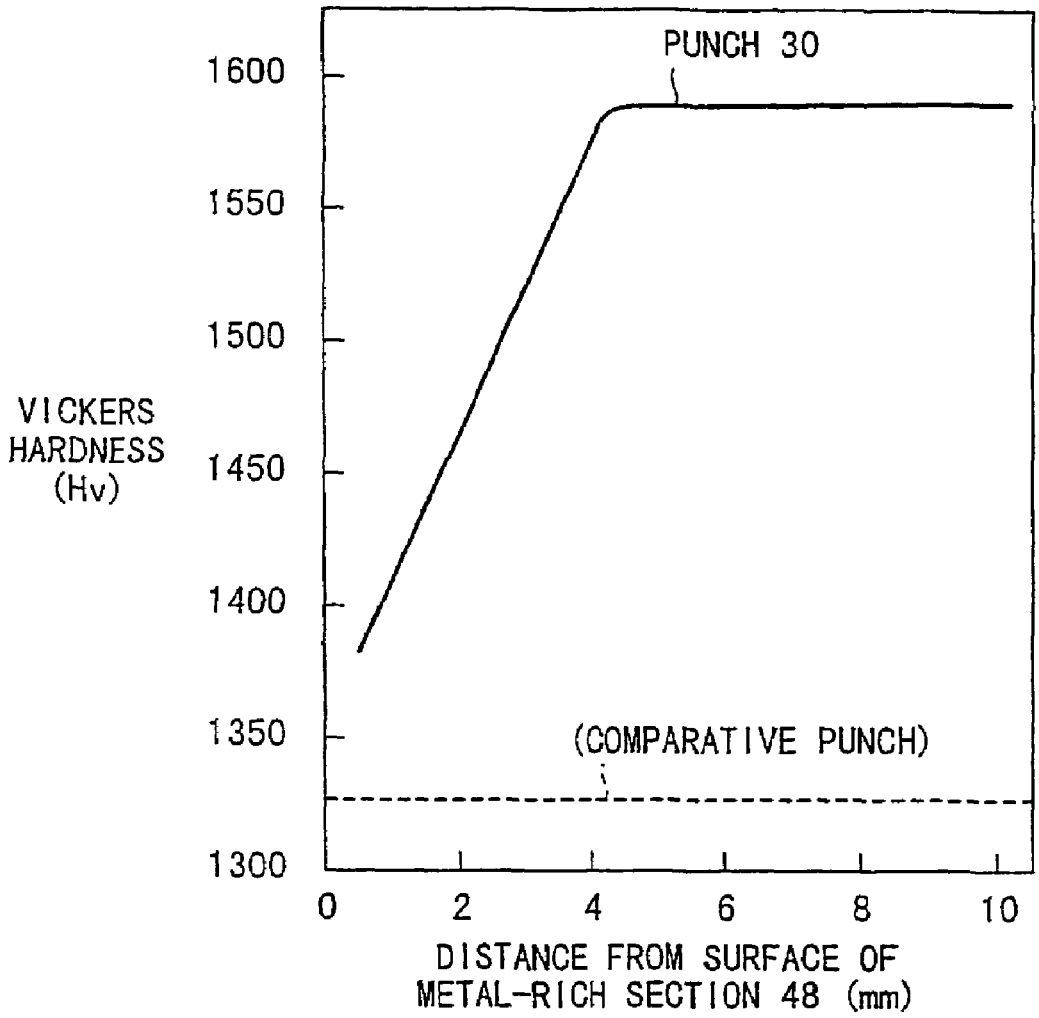
FIG. 6 is a graph illustrating Vickers hardness of the punch shown in FIG. 3 depending on the distance inwardly from an outer surface of the punch.

Then, the die 20, punch 30, comparative die, and comparative punch were cut for examining cross sectional surfaces of the die 20, punch 30, comparative die, and comparative punch. FIG. 5 shows Vickers hardness in the cross sectional surfaces of the die 20 and comparative die. FIG. 6 shows Vickers hardness in the cross sectional surfaces of the punch 30, and comparative punch. In FIG. 5, Vickers hardness of the die 20 is shown in the direction from the metal-rich section (outer surface) 40*b* to the metal-rich section (cavity surface) 40*a*. Similarly, Vickers hardness of the comparative die is shown from the outer surface to the cavity surface. In FIG. 6, Vickers hardness of the punch 30 is shown in the direction from the metal-rich section (outer surface) 48 to the ceramics rich section 46 (inner section). Similarly, Vickers hardness of the comparative punch is shown from the outer surface to the inner section.

As shown in FIGS. 5 and 6, the comparative die or the comparative punch has uniform Vickers hardness in its entire cross section. In contrast, the die 20 is composed of a gradient composite material in which Vickers hardness in the ceramics-rich section (inner section) 44 is high in comparison with Vickers hardness in the metal-rich sections 42*a*, 42*b*. The punch 30 is also composed of a gradient composite material in which Vickers hardness in the ceramics-rich section (inner section) 46 is high in comparison with Vickers hardness in the metal-rich section (outer surface) 48.

Next, flexural strength of the punch 30 and the comparative punch was examined. In the punch 30, the flexural strength of the metal-rich section 48 was 5.2 GPa, and the flexural strength of the ceramics-rich section 46 was 3.6 GPa. The flexural strength of the comparative punch was in the range of 2.8 GPa to 3.2 GPa. Therefore, the flexural strength of the punch 30 was significantly higher than the flexural strength of the comparative punch. Rigidity of the punch 30 and the comparative punch was also examined. The rigidity of the ceramics-rich section 46 was 597 GPa, which was 40 GPa higher than the rigidity of the comparative punch. It was found that the flexural strength and rigidity of the punch 30 were higher than those of the comparative punch.

Next, an experiment for testing durability of the punch 30 was performed. The movable table 14 was displaced downwardly toward the fixed table 12 to punch out holes in an SNCM630 having a thickness of 14 mm with the punch 30. It took one second for one punching. Punching was performed successively for a predetermined period of time. The maximum force applied to the SNCM630 was 4.3 GPa. It was determined whether any cracks, breakage, or deformation was formed in the punch 30 during the punching operation. Further, durability of the comparative punches were tested under the same condition. According to the experiment, the comparative punches were crashed under pressure after several shots to 230 shots (at the maximum) of punching operation. In contrast, the punch 30 was not deformed even after 800 shots of punching operation. No cracks or breakage were found in the punch 30.

Further, workpieces punched out by the punch 30 and the comparative punch were examined. It was found that the workpiece punched out by the punch 30 has smooth and accurate surfaces in comparison with the workpiece punched out by the comparative punch.

In the next experiment, an SCM420 having a thickness of 12 mm formed by backward extrusion in a cold forging process is used as a workpiece. In this case, the comparative punch was broken after 3,000 shots of punching operation. In contrast, the punch 30 was broken after 300,000 shots of punching operation.

Next, the punch 30 and the comparative punches were used as nut formers for making a nut by punching out a hole in an SUS304 or an SUS316 as a workpiece. The comparative punches used in the experiment include one which is coated with TiN. The punch press stamping was performed at the speed of 150 to 250 cpm. The comparative punch without any coating was not able to punch out the workpiece in a predetermined shape after 200,000 shots of punching operation. The comparative punch having TiN coating was not able to punch out the workpiece after 1,000,000 shots of punching operation. The punch 30 was able to make 1,300,000 to 1,400,000 holes in the workpiece with a high degree of surface accuracy.

It is clear from the above experiments that abrasion resistance and shock resistance of the punch 30 are better than those of the comparative punches.

Another experiment was performed for testing durability of the die 20. Cold forging was performed in the cavity 22 of the molding tool 10 with a JIS SUH35 equivalent material having a thickness of 8 mm for a predetermined period of time. The forming cycle was one second. The maximum force applied to the JIS SUH35 equivalent material was 2.8 GPa. It was determined whether any cracks, breakage, or deformation was formed in the punch 30 during the cold forging. Further, durability of the comparative dies was tested under the same condition. According to the experiment, cracks or breakage were formed in the comparative dies after 20 to 52 minutes. In contrast, no cracks or breakage were formed in the die 30 even after 10 hours.

Further, durability of the die 20 was tested using a JIS SUH 38 equivalent material in cold forging at the speed of 100 cpm. According to the experiment, the comparative dies were not able to plastic-deform the workpiece in a predetermined shape after 3,000 to 5,000 shots of cold forging operation. In contrast, the die 20 was able to plastically deform the workpiece for 100,000 shots of cold forging operation.

Then, the comparative die and the die 20 were used for plastically deforming the workpiece at a variety of different speeds. As a result, in the comparative die, cracks were formed at the speed of 180 m/s. In the die 20, cracks were formed at the speed of 560 m/s. That is, the die 20 can plastically deform the workpiece at a considerably high speed.

As described above, the molding tool according to the present invention includes the punch which is composed of the gradient composite material in which the composition ratio of the metal is decreased and the composition ratio of the ceramics is increased inwardly from the surface. Therefore, the punch according to the present invention has high hardness and strength as well as high toughness. Accordingly, the molding tool has the long service life, and the deformation scarcely occurs, because the molding tool is excellent in abrasion resistance. Further, the cracks and breakage scarcely occur. Furthermore, it is also possible to improve molding accuracy.

In the method of producing the molding tool according to the present invention, the porous member impregnated with the catalyst-containing solution is resintered in the nitrogen atmosphere to prepare the punch (gradient composite material). In this procedure, the grain growth of the ceramics grains existing in the vicinity of the surface of the porous member is suppressed with the nitrogen, while the grain growth of the ceramics grains existing in the porous member is facilitated with the catalyst. Accordingly, the metal grains are concentrated at the surface. Therefore, it is possible to obtain the punch in which the composition ratio of the metal is decreased and the composition ratio of the ceramics is increased inwardly from the surface, i.e., the punchy has high toughness at the surface and high hardness internally.

While the invention has been particularly shown and described with reference to a preferred embodiment, it will be understood that variations and modifications can be effected thereto by those skilled in the art without departing from the spirit and scope of the invention as defined by the appended claims.

The invention claimed is:

1. A molding tool comprising a punch for pressing a workpiece and a die having a cavity for receiving said punch, wherein at least one of said punch and said die is composed of a gradient composite material containing ceramics and metal, and wherein a composition ratio of said ceramics is increased and a composition ratio of said metal is decreased inwardly from a surface of said punch or said die.

2. The molding tool according to claim 1, wherein at least one of said punch and said die contains, as said ceramics, at least one selected from the group consisting of carbide, nitride, and carbonitride of W, Cr, Mo, Ti, V, Zr, Hf, and lanthanoid, and contains, as said metal, at least one selected from the group consisting of Fe, Ni, Co, and alloy comprising two or more of these metals, and said composition ratio of said ceramics to said composition ratio of said metal is 60:40 to 95:5 by weight.

3. The molding tool according to claim 2, wherein at least one of said punch and said die further contains, as said metal, at least one of Cr, Mn, V, and Ti.

4. The molding tool according to claim 1, wherein Vickers hardness of said surface of at least one of said punch and said die is not less than 1200.

5. The molding tool according to claim 3, wherein Vickers hardness of said surface of at least one of said punch and said die is not less than 1200.

* * * * *